United States Patent [19]

Hayase et al.

[11] Patent Number: 4,515,514

[45] Date of Patent: May 7, 1985

[54] VANE-TYPE ROTARY MACHINE

[75] Inventors: Isao Hayase, Katsuta; Atsushi Suginuma, Mito; Atsuo Kishi, Katsuta; Kenichi Kawashima, Ibaraki, all of Japan

[73] Assignee: Hitachi, Ltd., Tokyo, Japan

[21] Appl. No.: 404,647

[22] Filed: Aug. 3, 1982

[30] Foreign Application Priority Data

Aug. 12, 1981 [JP] Japan ..... 56-125226

[51] Int. Cl.[3] ..... F03C 2/00; F04C 18/00

[52] U.S. Cl. ..... 418/150

[58] Field of Search ..... 418/150, 236, 238

[56] References Cited

U.S. PATENT DOCUMENTS 1,999,187 4/1935 Gerlat et al. ..... 418/238

2,714,876 8/1955 Schmid ..... 418/238

*Primary Examiner*—William R. Cline

*Assistant Examiner*—John J. McGlew, Jr.

*Attorney, Agent, or Firm*—Antonelli, Terry & Wands

[57] ABSTRACT

A vane-type rotary machine for use as a compressor, pump or the like. The rotary machine has a cam ring with an inner peripheral contour expressed by an epitrochoid-like curve having at least one lobe, a cylindrical rotor having a plurality of vane grooves and contacting the inner peripheral surface of the cam ring, and vanes slidably received by the vane grooves and adapted to slide on the inner peripheral surface of the cam ring as the rotor rotates. The inner peripheral contour of the cam ring is corrected or modified in accordance with the amount of offset of the vanes in such a manner as to suppress the lateral reactional force applied to the vanes thereby to reduce the friction loss during sliding of the vanes in respective vane grooves, while making the sliding movement of the vanes approach a movement in accordance with a sine wave curve, thereby to diminish noise, thermal loss and mechanical damage which are attributable to irregularity of movement of the vanes.

2 Claims, 15 Drawing Figures n = 1 n = 2 n = 3

VANE-TYPE ROTARY MACHINE

BACKGROUND OF THE INVENTION

The present invention relates to a vane-type rotary machine suitable for use as a compressor, pump or the like apparatus.

Vane-type rotary machines are well known and generally used as compressors, pumps or the like. The vane-type rotary machine is provided with a cam ring with an inner peripheral contour which is represented by an epitrochoid-like curve having n lobes (n being a natural number), and a rotatable cylindrical rotor housed by the cam ring and adapted to make contact with the cam ring at n points. The rotor is provided with a plurality of radial vane grooves which are communicated with one another at the bottoms thereof, and vanes slidably and reciprocatably received by respective vane grooves and adapted to be pressed at their outer ends to the inner peripheral surface of the cam ring.

As shown in FIG. 1, a cam ring 1 has an inner peripheral surface of a contour which is expressed by an epitrocoid-like curve having a plurality of lobes, three lobes in this case, with a cylindrical rotor 3, having a plurality of vane grooves 2, being disposed in the cam ring 1 in contact with the latter. Vane grooves 2 receive vanes 4 which are held in resilient contact with the inner peripheral surface of the cam ring 1. When this vane-type rotary machine operates as a compressor, vanes 4 reciprocatingly move in respective vane grooves 2 while making sliding contact with the inner peripheral surface of the cam ring 1 as the rotor 3 rotates. Consequently, the volumes of the spaces 5 defined by the vanes 4, rotor 3 and cam ring 1 are cyclically changed to effect the compression.

It is well known that, in this ordinary vane-type rotary compressor, the angle $\alpha$ formed between the direction of reciprocation of the vane 4 and the line normal to the cam ring 1 at the point of contact by the end of the vane 4 is preferably small in order to reduce the loss of energy due to friction during reciprocation of the vane. Namely, if this angle $\alpha$ is too large, a large friction takes place between the vane 4 and the walls of the vane groove 2 due to a moment imparted to the vane 4 because the direction of reactional force exerted on the vane 4 by the cam ring 1 does not coincide with the direction of the vane groove. To obviate this problem, it has been proposed to arrange the vane grooves 2 at a certain offset D from the center of the rotor 3 to diminish the angle $\alpha$.

As shown in FIG. 2, vane grooves 2 are formed to extend tangentially to an imaginary circle of 2D in diameter and concentric to the rotor 3, to thereby reduce the angle $\alpha$ during returning of the vane 4 to thereby diminish the friction between the vanes 4 and the vane grooves 2.

The offset arrangement of the vanes 4, however, imposes the following problem, although it is effective in reducing the loss of energy due to friction. Namely, as will be seen from FIGS. 3*a*, 3*b* and 3*c*, the cam ring 1 of the known vane-type rotary machine has an inner peripheral contour which is symmetrical with respect to the perpendicular bisector of the line interconnecting two adjacent points of contact between the cam ring 1 and the rotor 3 in adjacent lobes (n=1, 2, 3). Therefore, if the vane 4 offset D is zero, the movement of the vane in its forward stroke and the movement of the same in its backward stroke, which take place along the vane groove 2 as the rotor 3 rotates, are in perfect symmetry with each other with respect to the abovementioned perpendicular bisector. However, if the vane offset D is not zero, the movement of the vane 4 in its forward stroke and the movement of the same in its backward stroke are not in symmetry with each other. The movement of the vane 4 in relation to the rotation angle of the rotor will be explained more fully with reference to FIGS. 4*a* to 4*d*. Assuming a vane-type rotary machine having a 3-lobe type cam ring 1 provided with an inner peripheral contour expressed by $r=40-5\cos 3\theta$ (mm), FIG. 4*a* shows the amount $r_v(\theta)$ of projection of the vane 4 from the rotor in relation to the rotation angle $\theta$ of the rotor. FIGS. 4*b* to 4*d* show, respectively, the differentiated values of the first, second and third degrees of the projection amount $r_v(\theta)$. In these Figures, the full-line curves show the values as obtained when the offset D is zero, while the broken-line curves show the values as obtained when the offset D is 15 mm. Thus, $r_v$ shown in FIG. 4*a* shows the position of the vane 4, $dr_v/d\theta$ shown in FIG. 4*b* represents the velocity of movement of the vane 4, $d^2r_v/d\theta^2$ shown in FIG. 4*c* represents the acceleration or inertia of the vane 4, and $d^3r_v/d\theta^3$ shown in FIG. 4*d* represents the rate of change of the inertia which is usually referred to as Jerk. As will be seen from these Figures, when the offset D is zero, all of the curves are ordinary sine curves due to the symmetric inner peripheral contour of the cam ring 1 expressed by $r=40-5\cos\theta$. This means that the vane 4 can move smoothly and cyclically. In contrast, when there is an appreciable offset D, the curves are largely deviated from the sine curves. This means that the vane 4 moves in an irregular manner. Particularly, the rate of change of the inertia is seriously large. This irregular change in the inertia causes not only a phenomenon called chattering in which the vane 4 vibratorily comes into and out of contact with the cam ring but also various other problems such as breakage of oil film on the inner peripheral surface of the cam ring 1. Furthermore, the volume of the spaces behind respective vanes, which are all in communication with one another, is irregularly changed to promote the tendency of chattering to cause loss of heat.

It will be understood that the offset of the vane grooves 2, without being accompanied by a suitable change in the inner peripheral contour of the cam ring 1, makes the movement of the vanes 4 quite irregular to cause various problems such as increase of the friction loss and increased level of noise produced by the vanes. Consequently, the aforementioned advantage of the offset arrangement, i.e. the reduction of the friction loss through reduction in the reactional force produced at the point of contact between the end of the vane and the inner peripheral surface of the cam ring, is completely negated to make the vane offset arrangement meaningless. Thus, there is no substantial advantage in providing a large offset of the vane grooves. This problem is serious particularly when the number of lobes in the cam ring is increased.

SUMMARY OF THE INVENTION

Accordingly, an object of the invention is to provide a vane-type rotary machine which can operate with reduced loss and at lowered level of noise, by eliminating the above-explained problems attributable to the offset arrangement of the vane grooves while making full use of the advantage of the offset arrangement, i.e.

the reduction in the friction loss during sliding of the vanes, thereby to overcome the drawbacks of the prior art.

To this end, according to the invention, there is provided a vane-type rotary machine incorporating a cam ring having an epitrocoid-like inner peripheral contour, wherein the inner peripheral contour of the cam ring is modified in such a manner that the angle formed around the center of the rotor between the point at which the rotor contacts the cam ring and the point of maximum projection of the vane from the rotor located at the leading side of the first-mentioned point as viewed in the direction of rotation of the rotor is varied in accordance with the amount of offset of the vanes so as to exceed $\pi/n$, thereby to eliminate irregular movement of the vanes. Consequently, it is possible to fully enjoy the advantage of the offset arrangement of vanes without being accompanied by any detrimental effects attributable to the offset arrangement.

More specifically, the maximum projection amount of the vane is observed not at the midst of the rotation angle of the rotor but at a point which is located at the trailing side of the midst point as viewed in the direction of rotation of the rotor, when there is an offset of the vane grooves as will be seen from broken line curve in FIG. 4*a*. This seems to be the reason why the broken-line curves in FIGS. 4*b* to 4*d* deviate from sine curves.

It is possible to shift the point of maximum vane projection in the direction of rotation of the rotor by shifting the point at which the distance between the cam ring and the center of rotation of the rotor takes the maximum value $r_{max}$ in the same direction. By so doing, the peaks of the broken-line curve in FIG. 4*a* is shifted also in the direction of rotation of the rotor, i.e. to the right as viewed in FIG. 4*a* to approach the sine wave shown by full line. The same applies to the broken-line curves in FIGS. 4*b*, 4*c* and 4*d*. Namely, in these Figures, the broken-line curves are deformed to approach the sine curves shown by full lines. This means that the irregularity of the movement of the vanes is avoided and, hence, the problems attributable to the offset of vanes are eliminated.

According to the invention, the epitrocoid-like curve of the inner peripheral contour of the cam ring is modified such that the amount of projection of vane takes the maximum value when the rotor is rotated by $\pi/n$ from the point of contact between the cam ring and the rotor to bring the opening of the vane groove to this position. Consequently, the amount of projection of the vane takes the maximum value at each time the rotor makes a $\pi/n$ rotation, so that the broken-line curves in FIGS. 4*a* to 4*d* approximate the sine wave curves. Namely, the irregularity of movement of the vanes is suppressed remarkably.

The above and further objects and novel features of the invention will become more apparent from the following detailed description when taken in conjunction with the accompanying drawings.

DETAILED DESCRIPTION OF THE INVENTION

Figure 6:
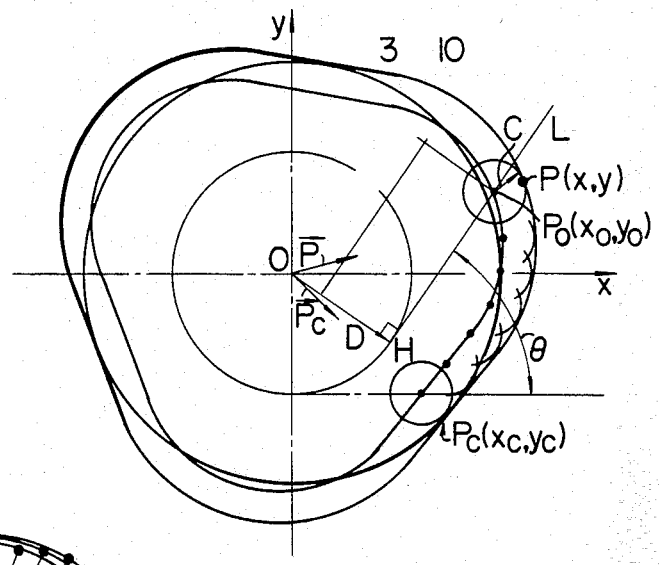
FIG. 6 is a schematic view illustrating a principle for determining a contour of a cam ring in a vane-type rotary machine constructed in accordance with one embodiment of the present invention.

FIG. 6 shows a vane-type rotary machine having a cam ring improved in accordance with an embodiment of the invention, with a cam ring 10 being formed in accordance with the following procedure.

An imaginary circle has a radius C and is centered at a point Po ($x_o$, $y_o$) located on a line L spaced by a distance D from the center 0 of the rotor 3. A line perpendicular to the line L and passing the center 0 of the rotor 3 intersects the line L at a point H. The distance l between the point H and the center Po of the circle having the radius C makes a single oscillation as a function of the rotation angle $\theta$ of the rotor 3 in accordance with the following formula:

$$l = A - B\cos(n\theta) \tag{1}$$

where, A and B represent constants, while n represents a natural number coinciding with the number of lobes. In such a case, the point P(x,y) of contact between the circle of radius C and the outer envelope of the circles of radius C and centered at points Po corresponding to respective angles $\theta$ is determined as a function of the rotation angle $\theta$ of the rotor 3, in accordance with the following formula:

$$\left.\begin{aligned} X &= B\sin\theta + (A - B\cos n\theta)\cdot\cos\theta + \\ &\quad C\cdot\frac{D\sin\theta + (A - B\cos n\theta)\cos\theta + nB\sin n\theta\cdot\sin\theta}{\sqrt{D^2 + (A - B\cos n\theta)^2 + n^2B^2\sin^2 n\theta + 2nB\cdot D\cdot\sin n\theta}} \\ Y &= -D\cos\theta + (A - B\cos n\theta)\sin\theta + \\ &\quad C\cdot\frac{-D\cos\theta + (A - B\cos n\theta)\sin\theta - nB\sin n\theta\cdot\cos\theta}{\sqrt{D^2 + (A - B\cos n\theta)^2 + n^2B^2\sin^2 n\theta + 2nBD\cdot\sin n\theta}} \end{aligned}\right\} \tag{2}$$

The formula (2) on the other hand expresses the form of the curve which is the envelope of the aforementioned circles drawn by using the angle $\theta$ as the parameter. The vane 4 can move allowing a sine wave curve correctly, provided that the inner peripheral contour of the cam ring 10 is formed in accordance with the coordinate values x and y defined as above.

The point at which the position of maximum vane projection is formed can be expressed as follows in terms of rotation angle of the rotor 3 and the number of the lobes.

The point at which the rotor 3 and the cam ring 10 contact each other is expressed by $Pc(x_c,y_c)$, while the point at which the position of maximum vane projection is formed, i.e. the point on the cam ring remotest from the rotor center 0, is expressed by Pm $(x_m,y_m)$. In FIG. 6, the aforementioned point P is located at the position of the point Pm. Substituting 0 (zero) for $\theta$ in formula (2), the coordinate positions $x_c$ and $y_c$ of the point Pc are given as follows:

$$\left.\begin{aligned} x_c &= (A-B)\cdot\left[1+\frac{C}{\sqrt{D^2+(A-B)^2}}\right] \\ y_c &= -D\cdot\left[1+\frac{C}{\sqrt{D^2+(A-B)^2}}\right] \end{aligned}\right\} \quad (3)$$

Therefore, the unit vector Pc in the direction of Pc is expressed by the following formula (4).

$$P_c = \left(\frac{x.}{\sqrt{x_c^2+y_c^2}}, \frac{y.}{\sqrt{x_c^2+y_c^2}}\right) = \frac{(A-B)}{\sqrt{D^2+(A-B)^2}}, \frac{-D}{\sqrt{D^2+(A-B)^2}}$$

Substituting $\pi/n$ for $\theta$ in formula (2), the coordinate values $x_m,y_m$ of the point for forming the position of maximum vane projection are determined as follows:

$$\left.\begin{aligned} x_m &= \left\{D\sin\frac{\pi}{n}+(A-B)\cos\frac{\pi}{n}\right\}\cdot\left(1+\frac{C}{\sqrt{D^2+(A+B)^2}}\right) \\ y_m &= \left\{-D\cos\frac{\pi}{n}+(A-B)\sin\frac{\pi}{n}\right\}\cdot\left(1+\frac{C}{\sqrt{D^2+(A+B)^2}}\right) \end{aligned}\right\} \quad (5)$$

The unit vector $\overrightarrow{Pm}$ in the direction of Pm is given as follows:

$$Pm = \left(\frac{x_m}{\sqrt{x_m^2+y_m^2}}, \frac{y_m}{\sqrt{x_m^2+y_m^2}}\right) = \left(\frac{D\sin\frac{\pi}{n}+(A+B)\cos\frac{\pi}{n}}{\sqrt{D^2+(A+B)^2}}, \frac{-D\cos\frac{\pi}{n}+(A+B)\sin\frac{\pi}{n}}{\sqrt{D^2+(A+B)^2}}\right) \quad (6)$$

Representing the central angle ∠PcOPm by $\phi$, the following formula (7) is derived:

$$\sin\phi = \overrightarrow{Pc}\times\overrightarrow{Pm} = \frac{(A^2-B^2+D^2)\sin\frac{\pi}{n}+2DB\cos\frac{\pi}{n}}{\sqrt{(A^2-B^2+D^2)^2+4D^2B^2}} \quad (7)$$

The central angle $\phi$ is determined by the following formula (8) which is obtained by transforming formula (7).

$$\phi = \sin^{-1}\left\{\frac{(A^2-B^2+D^2)\sin\frac{\pi}{n}+2DB\cos\frac{\pi}{n}}{\sqrt{(A^2-B^2+D^2)^2+4D^2B^2}}\right\} \quad (8)$$

According to the invention, the inner peripheral contour of the cam ring 10, which is expressed by an epitrocoid-like curve having n lobes, is determined in accordance with formula (2), i.e. such that the central angle $\phi$ formed between the point at which the amount of projection of vane 4 is zero and the point Pm for forming the position of maximum projection of the vane 4 is determined in accordance with formula (8).

When this cam ring 10 is used, the amount D of offset is given by the following formula (9), assuming that the end of the vane 4 has a form of an arc having a radius C and representing the offset of the center of the above-mentioned arc from the thicknesswise bisector of the vane 4 by ΔD and the distance of the neutral axis of the vane groove 2 from the center of the rotor 3 by $D_1$.

$$D = D_1 - \Delta D \quad (9)$$

It is clear from the formula (1) mentioned before that, provided that the offset D is determined in the manner explained hereinbefore, the vane 4 which slides at its end along the inner peripheral surface of the cam ring 10 makes a single oscillation correctly in accordance with a sine wave curve within the vane groove 2.

Figure 7:
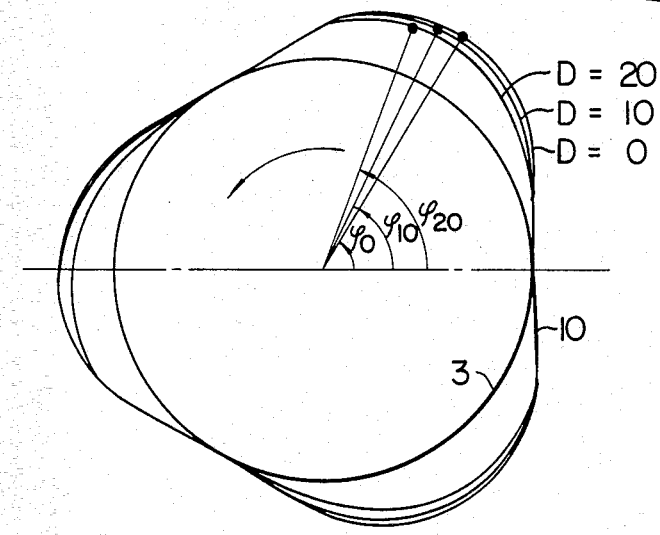
FIG. 7 is a schematic view of a vane type rotary machine constructed in accordance with the present invention.

FIG. 7 shows practical examples of configuration of the inner peripheral contour of the cam ring 10 for various amounts of offset D. Namely, FIG. 7 shows the inner peripheral configurations of the cam ring 10 obtained when the offset D is zero mm, 10 mm and 20 mm, respectively, under the condition of n=3, B=5 mm, d (rotor diameter)=70 mm and c=5.5 mm.

The constant A appearing in preceding formulae is expressed as follows:

$$A = \sqrt{(d/2-c)^2-D^2}+B \quad (10)$$

From FIG. 7, it will be seen that the amount of shift of the position of maximum distance $r_{max}$ in the direction of rotation of the rotor 3 is increased as the amount of offset D of the vane 4 is increased. The central angle which takes progressively increasing value $\phi_o$, $\phi_{10}$ and then $\phi_{20}$ in accordance with the increase of the offset amount D is easily determined by the formula (8).

Figure 1:
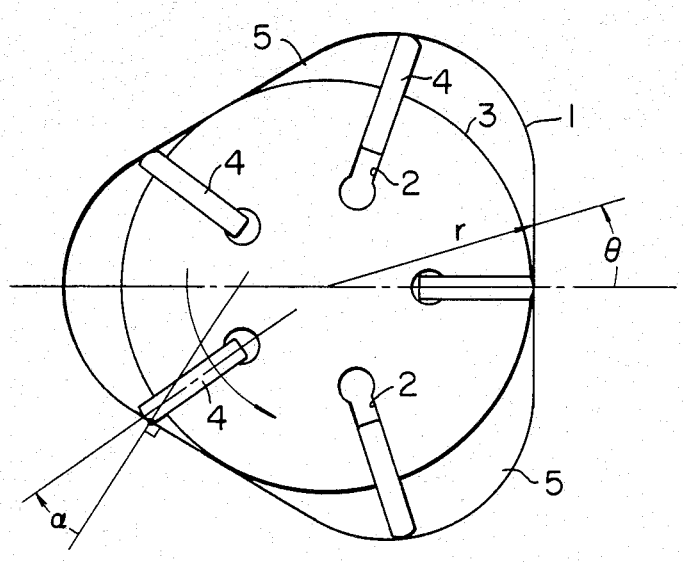
FIG. 1 PRIOR ART
FIG. 1 is a schematic view of a conventional vane type rotary machine.
Figure 2:
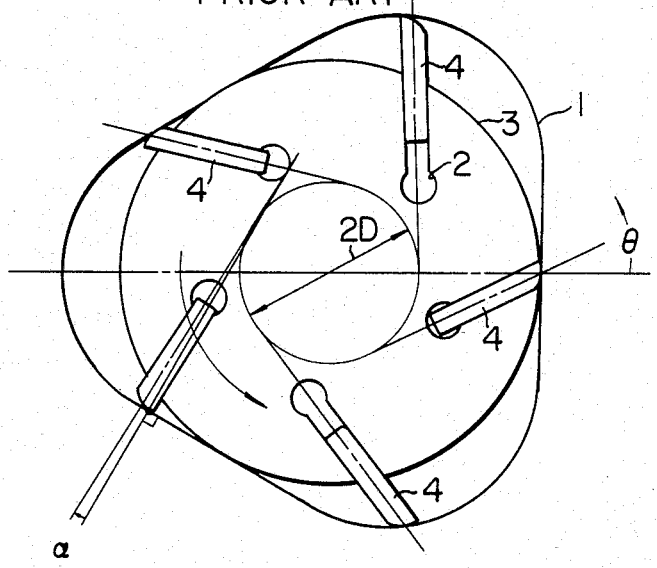
FIG. 2 PRIOR ART
FIG. 2 is a schematic view of another conventional vane-type rotary machine with vanes thereof offset from a center of a rotor.
Figure 3A:
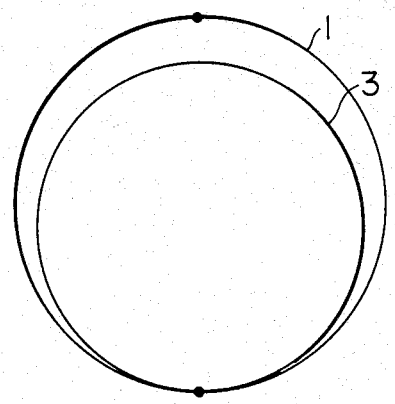
FIG. 3a PRIOR ART
FIGS. 3*a*–3*c* are schematic views respectively illustrating conventional cam rings having one, two, and three lobes.
Figure 3B:
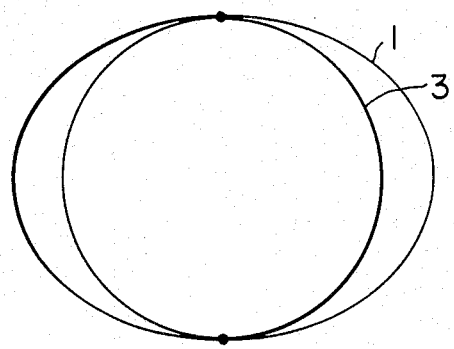
FIG. 3b PRIOR ART
Figure 3C:
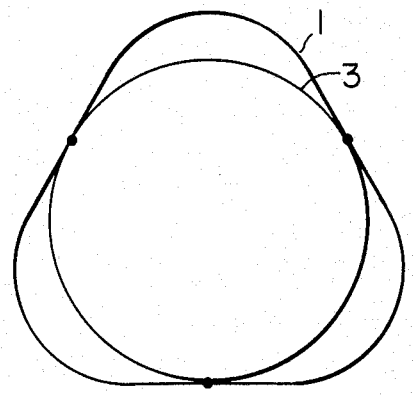
FIG. 3c PRIOR ART
Figure 4A:
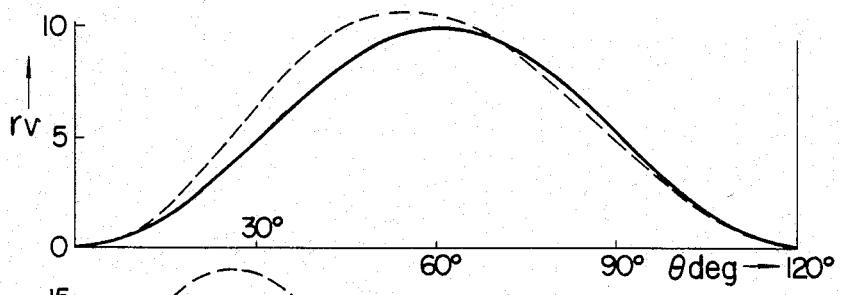
FIG. 4a PRIOR ART
FIGS. 4*a*–4*d* are graphical illustrations of a relationship between a displacement of a vane and a rotation angle of a rotor of the vane-type rotary machine of FIG. 2.
Figure 4B:
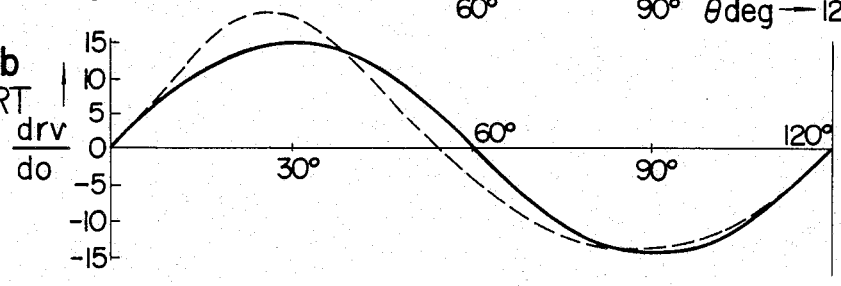
FIG. 4b PRIOR ART
Figure 4C:
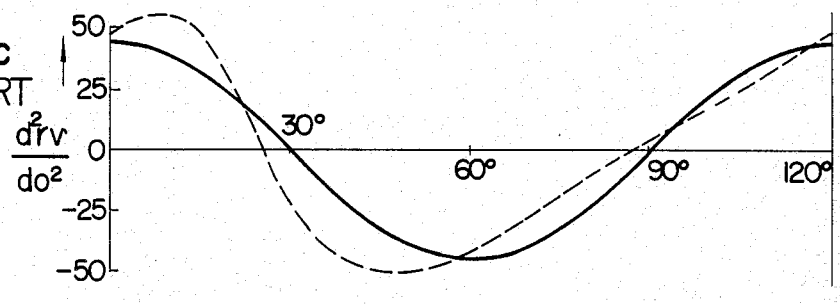
FIG. 4c PRIOR ART
Figure 4D:
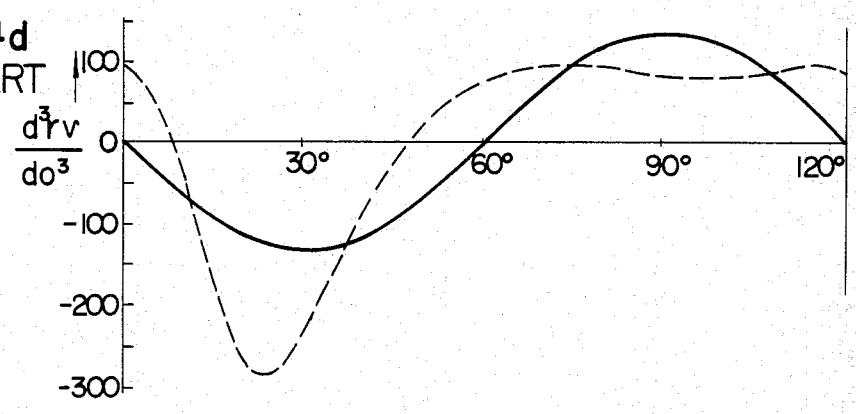
FIG. 4d PRIOR ART
Figure 5:
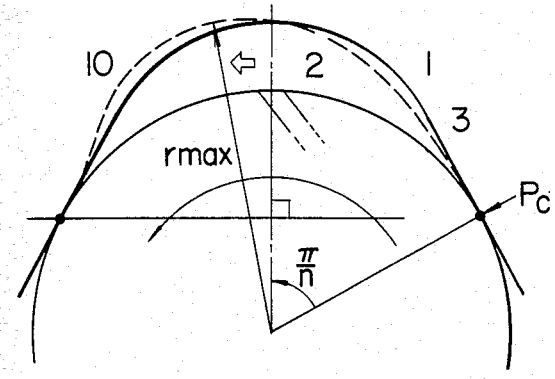
FIG. 5 is a schematic illustration of a cam ring showing a point formation of a maximum projection of a vane.

In vane-type rotary machine having the cam ring 10 constructed as above, the vane 4 completes one reciprocation cycle while the rotor 3 rotates between two adjacent points of contact with the cam ring 10. The amount of projection of the vane 4 is maximized when the rotor 3 is rotated by an angle $\pi/n$ from the position at which the rotor 3 contacts the inner peripheral surface of the cam ring 10. The point for forming the position of maximum vane projection is determined such that the central angle $\phi$ of this point exceeds $\pi/n$. Consequently, the vane projection amount $r_v$ shown by broken-line curve in FIG. 4*a* approaches the sine wave curve and, accordingly, the other broken-line curves shown in FIGS. 4*b*, 4*c* and 4*d* approach the sine wave curves. This means that the vane 4 can move correctly in accordance with the sine wave curve and, hence, any irregularity in the vane movement is eliminated.

Figure 8:
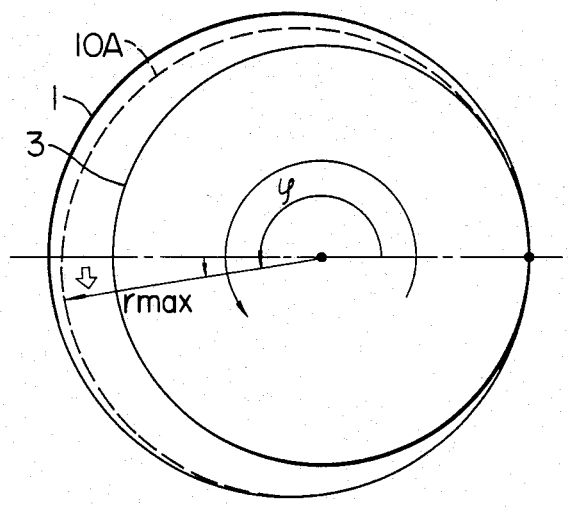
FIG. 8 is a schematic view of another embodiment of the present invention.
Figure 9:
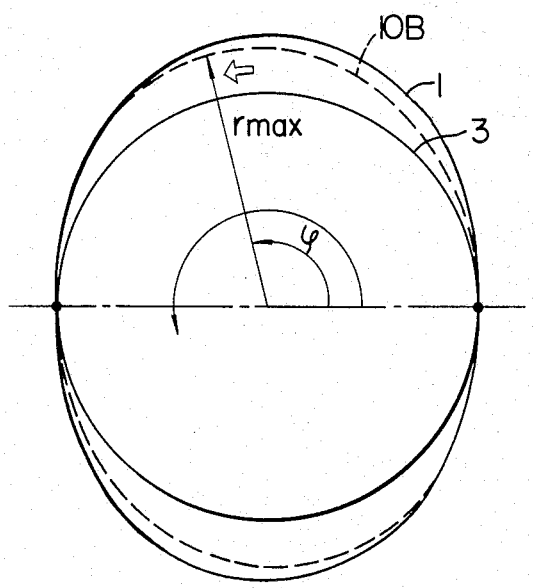
FIG. 9 is a schematic view of a still further embodiment of the present invention.

FIGS. 8 and 9 show different embodiments of the invention. More specifically, FIGS. 8 and 9 show, respectively, the inner peripheral contours of a cam ring 10A having a single lobe (n=1) and a cam ring 10B having two lobes (n=2) as obtained under the same condition as the first-mentioned practical embodiment, i.e. under the condition of B=5 mm, d (rotor outside diameter)=70 mm, and C=5.5 mm, for each case of D=0 mm and D=20 mm. From these embodiments, it will be understood that the position of the maximum distance $r_{max}$ is shifted from the position of $\pi/n$ in the direction of rotation of the rotor regardless of the number n of the lobes, on condition of D>0.

Provided that all of the vanes 4 make oscillations in accordance with sine wave curves, it is possible to perfectly eliminate any fluctuation in the total volume of the spaces behind the vanes 4 to completely avoid any loss of energy due to compression or expansion of the gas in such spaces, by suitably selecting the combination of the number of the vanes 4 and the number n of the lobes.

As has been described, according to the invention, the position of the point on the cam ring 10 remotest from the center of the rotor 3 is shifted in the direction of rotation of the rotor 3 by an amount corresponding to the amount of offset D of the vanes 4. By so doing, any irregularity of the movement of the vanes 4 due to the offset arrangement is completely eliminated to permit the vanes 4 to make a sine wave oscillation or a similar smooth movement. Consequently, it is possible to obtain a vane-type rotary machine which can operate with reduced friction loss and reduced level of noise and which has an improved durability.

Figure 10:
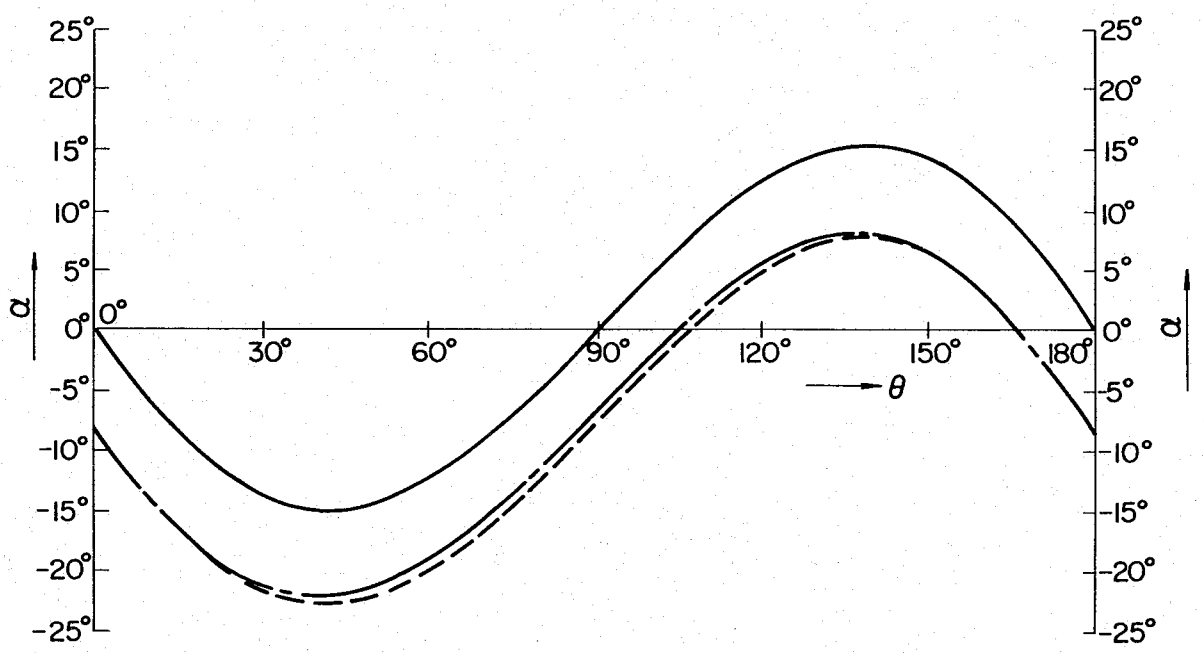
FIG. 10 is a graph illustrating a relationship between a rotation angle of a rotor and an angle formed between a vane and inner peripheral surface of the cam ring.

FIG. 10 shows the characteristics of the vane-type rotary machine of the invention with respect to the aforementioned angle $\alpha$ which is one of the factors of increase in the friction loss during the sliding of the vanes. The characteristics are shown in connection with a 2-lobe type cam ring. In FIG. 10, the axis of abscissa represents the angle of rotation of the rotor while the axis of ordinate represents the angle $\alpha$ which is the angle formed between the vane and the line normal to the cam ring at the point of contact between the vane end and the cam ring. More specifically, in FIG. 10, the full-line curve shows how the angle $\alpha$ is changed in relation to the rotor rotation angle $\alpha$ in a rotary machine having no offset of the vanes 4 nor the shift of the cam ring 10. Similarly, the broken-line curve shows the angle $\alpha$ as observed in a rotary machine in which the vanes 4 are arranged at an offset D but there is no shift in the inner peripheral contour of the cam ring 10, while the chain-line curve shows the angle $\alpha$ as observed in the rotary machine of the invention in which the vanes 4 are arranged at an offset D and the inner peripheral contour of the cam ring 10 is shifted in the direction of rotation of the rotor 3. It will be understood that the chain-line curve well approximates the broken-line curve. Thus, the angle $\alpha$ in the rotary machine of the invention does not take such large values as those exhibited in the conventional rotary machine having no offset of the vanes 4. This means that the friction loss during sliding of the vanes 4 is sufficiently reduced according to the present invention.

While a preferred embodiment of the invention has been described using specific terms, such description is for illustrative purpose only, and it is to be understood that changes and variations may be made without departing from the spirit or scope of the following claims.

What is claimed is:

1. A vane-type rotary machine comprising: a cam ring having an inner peripheral surface contour expressed by an epitrocoid-like curve having n lobes; a cylindrical rotor having a plurality of vane grooves and contacting the inner peripheral surface contour of said cam ring; and vanes slidably received by said vane grooves and adapted to slide on the inner peripheral surface contour of said cam ring as said rotor rotates, the inner peripheral surface contour of said cam ring is constructed such that a center angle formed around a center of said rotor and between a point at which said rotor contacts said cam ring at a point forming a position of maximum projection of the vane located at a leading side of the point of contact, as viewed in a direction of rotation of the rotor, exceeds an angle $\pi/n$ by an amount increasing with an amount of offset of said vanes so as to enable a smooth substantially sinusoidal movement of the vanes upon rotation of the rotor.

2. A van-type rotary machine comprising: a cam ring having an inner peripheral surface contour expressed by an epitrocoid-like curve having n lobes; a cylindrical rotor having a plurality of vane grooves and contacting the inner peripheral surface contour of said cam ring; and vanes slidably received by said vane grooves and adapted to slide on the inner peripheral surface contour of said cam ring as said rotor rotates, the inner peripheral surface contour of said cam ring is constructed such that a center angle formed around a center of said rotor and between a point at which said rotor contacts said cam ring at a point forming a position of maximum projection of the vane located at a leading side of the point of contact, as viewed in a direction of rotation of the rotor, exceeds an angle $\pi/n$ in accordance with an amount of offset of said vanes so as to enable a smooth substantially sinusoidal movement of the vanes upon rotation of the rotor, and wherein the center angle is given as a function of the amount of offset of said vanes in accordance with the following formula:

$$\phi = \sin^{-1}\left\{\frac{(A^2 - B^2 + D^2)\sin\frac{\pi}{n} + 2DB\cos\frac{\pi}{n}}{\sqrt{(A^2 - B^2 + D^2)^2 + 4D^2B^2}}\right\},$$

where:

$\phi$ represents the center angle,

A and B represent constants, n represents the number of lobes, and

D represents the amount of offset of said vanes.

* * * * *